US005085317A

United States Patent [19]

Jensen et al.

[11] Patent Number: 5,085,317

[45] Date of Patent: Feb. 4, 1992

[54] LIQUID-CONTAINING CONTAINER

[75] Inventors: Svend V. Jensen, Roskilde; Erik F. Andersen, Helsincør, both of Denmark

[73] Assignee: Flügger A/S, Rødovre, Denmark

[21] Appl. No.: 572,934

[22] PCT Filed: Mar. 15, 1989

[86] PCT No.: PCT/DK89/00057

§ 371 Date: Sep. 11, 1990

§ 102(e) Date: Sep. 11, 1990

[87] PCT Pub. No.: WO89/08590

PCT Pub. Date: Sep. 21, 1989

[30] Foreign Application Priority Data

Mar. 15, 1989 [DK] Denmark ..... 1410/88

[51] Int. Cl.[5] ..... B65D 25/04

[52] U.S. Cl. ..... 206/229; 15/257.06; 206/362; 220/410

[58] Field of Search ..... 15/257.05, 257.06; 206/1.7, 209, 229, 361, 362; 220/90, 410, 521

[56] References Cited

U.S. PATENT DOCUMENTS

| | | | |
|---|---|---|---|
| 2,127,682 | 8/1938 | Ewing | 206/209 |
| 2,515,703 | 7/1950 | Dumas . | |
| 2,613,011 | 10/1952 | Foreshaw-Smith | 206/554 |
| 3,241,706 | 3/1966 | Monaco et al. | 220/410 |
| 3,401,535 | 9/1968 | Palmer | 220/410 |
| 4,682,705 | 7/1987 | Hurwitz | 220/90 |
| 4,834,237 | 5/1989 | Henke et al. | 15/257.06 |

FOREIGN PATENT DOCUMENTS

| | | | |
|---|---|---|---|
| 466274 | 11/1973 | Australia . | |
| 2087688 | 12/1971 | France . | |
| 2547774 | 12/1984 | France . | |
| 1010450 | 11/1965 | United Kingdom . | |
| 2187704 | 9/1987 | United Kingdom | 220/90 |

*Primary Examiner*—Jimmy G. Foster

*Attorney, Agent, or Firm*—Watson, Cole, Grindle & Watson

[57] ABSTRACT

A liquid-containing container (1) comprising a removable lid (7) and a liquid-tight protective membrane (10) which is located between the surface of the liquid (6) and the lid (7) and is attached to the inside of the container (1), said protective membrane (10) being connected with a relatively rigid element (11) with depressions (12, 13) for fixing tools (14, 15) in the container.

5 Claims, 2 Drawing Sheets

LIQUID-CONTAINING CONTAINER

BACKGROUND AND SUMMARY OF THE INVENTION

The invention relates to a liquid-containing container comprising a removable lid, and in which a tool holding element is provided in the interior of the container, but protected from the liquid therein, for the accommodation of one or more tools for use in the utilization of the liquid in the container.

A container of the kind described is known from AU,B, 466274. This known container has a lid consisting of a first or inner layer adhered to a peripheral flange at the top of the container, and a second or outer layer attached to the first layer in such a manner that iy can be peeled back from it to give access to a tool accommodated in a tool holding element formed by a recess in the first layer, which is moreover provided with a severance line to give access to the interior of the container after the tool has been taken out of the recess.

The known container is a food container, and after the outer layer has been peeled back and the tool has been taken out and the severable portion of the inner layer has been removed, the tool, which may, e.g., be a spoon, a fork or a drinking straw, can be used for extracting the food for immediate consumption.

The lid construction of the known container would not be suitable for a container, such as a paint container, where it is a requirement that the lid can be used for renewed effective closing of the container after use of a part only of the liquid in the container, and/or that it should be possible to maintain the lid in an erected position during the process of utilization of the liquid, e.g., in the application of paint by means of a painting roller.

It is an object of the invention to provide a liquid-containing container of the kind described, which fulfils the above-mentioned requirements. To achieve this object, according to the invention, the tool holding element is a structural part separate from the lid and is connected to a liquid tight membrane located between the surface of the liquid and the lid and is attached to the inside of the container.

Liquid-containing containers comprising a removable lid and a liquid-tight protective membrane located between the surface of the liquid and the lid and being attached to the inside of the container are known per se.

Typically, paint containers of this type are made form a plastics material, and usually the protective membrane is a film which is heat welded onto the inside of the container.

The protective membrane serves to prevent loss caused by evaporation of volatile components of the paint such as solvents and preservatives in cases where the lid does not provide sufficient protection against loss by evaporation. This is especially the case in connection with large paint containers where the side and/or end walls can easily become so deformed during transport that leaks are formed between lid and container mouth.

This invention is based on the recognition that the protective membrane can also be utilized for an additional purpose, viz. for carrying a tool holding means as described in such a manner that tools accommodated therein are protected from the liquid in the container. Thus, no additional structural means have to be provided for carrying the tool holding element, and the lid is entirely unaffected by the tool holding function and therefore can be constructed and used to fulfill any specific requirements.

The tool holding element preferably consists of a vacuum-shaped tool tray, and advantageously this tool tray can be fastened to the under side of the protective membrane, e.g., by welding or glueing.

It is to be noted, though, that the protective membrane does not necessarily have to extend over the tool tray which in that case should be made from a diffusion-tight material.

The container of the invention is particularly suitable for packing paint.

In connection with the sale of paint through a paint dealer, there is often a need to tone the paint in order to achieve a colour which is closely adjusted to the customer's wishes.

In order to fulfil this need the tool tray preferably comprises a hole which is covered by a thin membrane which constitute a part of the above-mentioned protective membrane. When the paint is to be toned, as hole is cut out in the membrane and the colour concentrate for toning is added to the paint through the hole. Then the hole is closed, e.g., by means of tape.

Subsequently the paint container is placed in an apparatus for vibrating the paint and distributing the tone therein.

When the user is to use the optionally toned paint, that part of the protective membrane which may cover the tool tray is removed with a knife and the painting tools can be removed. Then the tool tray is removed by cutting the membrane along the inside of the container. The container is preferably designed so that part of the protective membrane is adapted to remain therein. Thus, e.g., a corner of the membrane can comprises a sheet-shaped element having a hole of such shape that a paint brush can be placed therein in an approximately vertical position.

The depressions in the relatively rigid element are preferably shaped in such a way that a paint roller with handle and/or one or more paint brushes can be placed therein.

As mentioned above, the container of the invention is particularly suitable for packing paint. It can be used for packing various other liquid media which are to be applied onto a surface by means of simple tools, such as paint brush, paint roller and the like.

The invention will now be described in further detail with reference to the drawings; and

DETAILED DESCRIPTION OF THE PREFERRED EMBODIMENT

Figure 3:
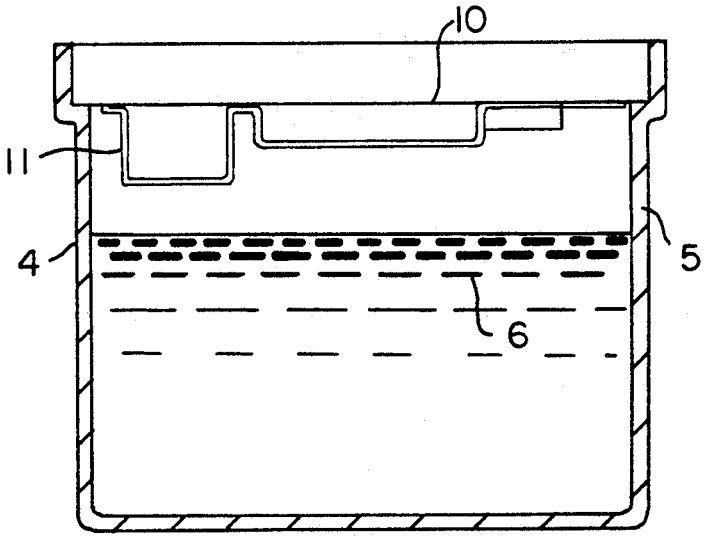
FIG. 3 shows a sectional view along the line III—III through the paint container of FIG. 2 without tools.

In the drawing 1 is a rectangular plastic container comprising two side wall 2 and 3 and two end walls 4 and 5. The plastic container is partly filled with paint 6 (see FIG. 3). The side wall 3 to hinge-connected with a lid 7 which can be fastened in a position in which the lid 7 forms an extension of the side wall 3 by means of a handle 8, the ends of the handle being rotably mounted in fastening means 9 located on the outer side of the end walls 4 and 5 of the container. The container 1 comprises a membrane 10 (see FIG. 3) which is welded along its edges onto the inner side of the side walls 2, 3 and the end walls 4,5 of the container.

A tool tray 11 is fastened to the under side of the membrane 10. A paint roller with handle 14 and a paint brush 15 are placed in corresponding depressions 12 and 13 in the tool tray 1. Furthermore, the tool tray 11 comprises a hole 16 for introducing tone in that part of the container 1 which is located below the membrane 10.

Finally, a corner of the container 1 comprises a sheet-shaped element 17 with a weakened line 18. When cutting through the sheet-shaped element 17 along the weakened line 18, an incission 19 is formed and this incission can be used as paint brush holder.

Figure 1:
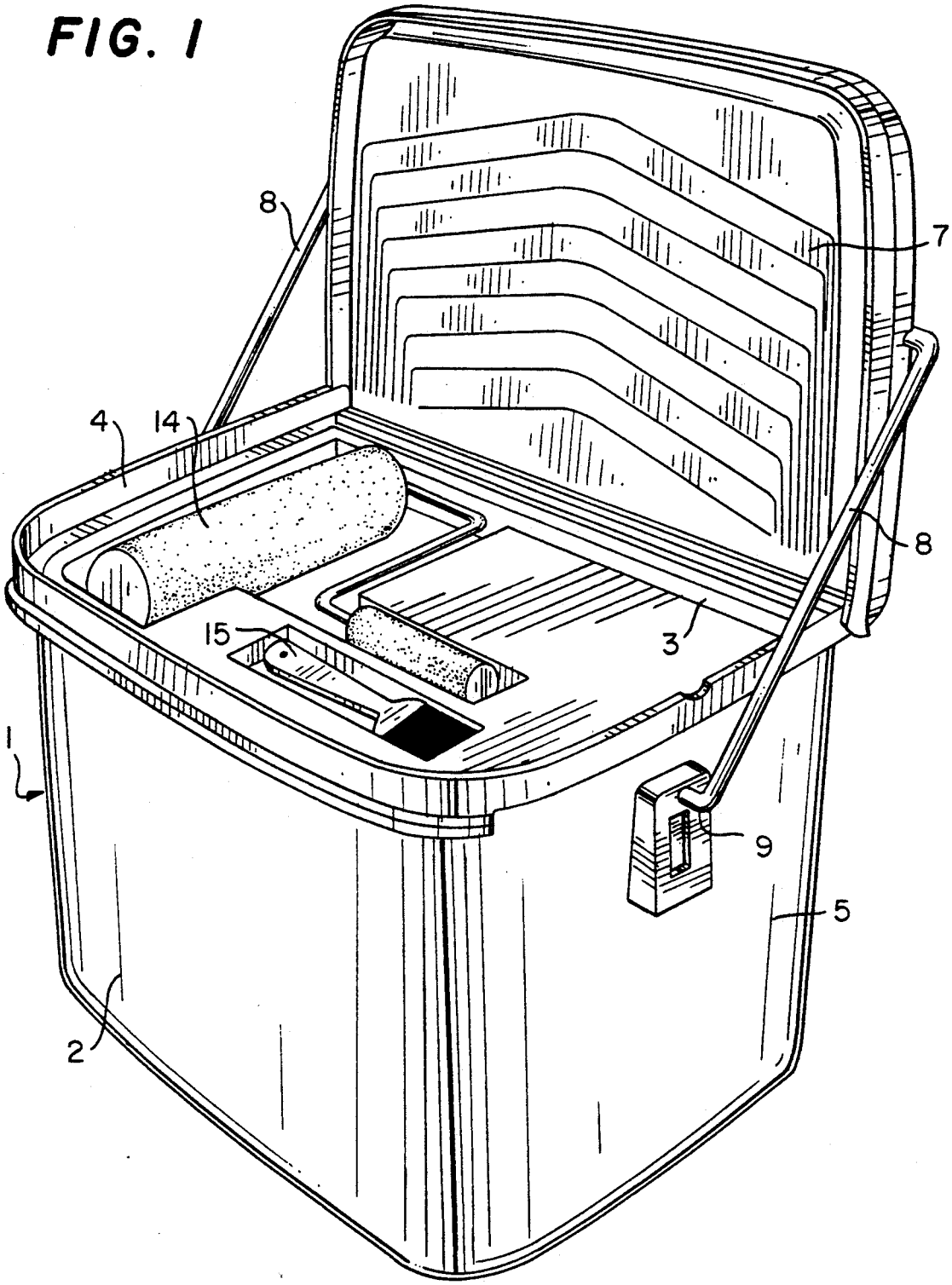
FIG. 1 shows a perspective view of a paint container of the invention.
Figure 2:
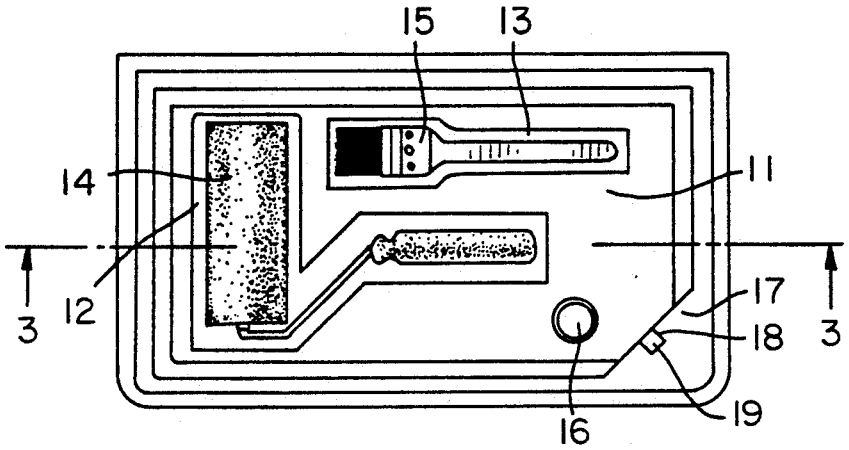
FIG. 2 shows a paint container of the invention without lid seen from above and with a part of the membrane cut away.

When a user is to start painting, the lid 7 is opened and placed in the position shown in FIG. 1. Then part of the membrane 10 covering the tool tray 11 is cut away and the paint roller 14 and the paint brush 15 are taken out. Then the tool tray 11 is cut free by cutting through the membrane 10 close to the side walls 2, 3 and end walls 4, 5 of the container 1, and in this connection the sheet-shaped element 17 is cut along the weakened line 18 to form the incission 19.

Then the painting operation can be started, and when the paint brush 15 is not in use it can be placed in a vertical position in the incission 19. In this position the brushes of the paint brush are positioned relatively close to the surface of the paint and the paint on the brush will be less inclined to dry than when the brush is placed outside the container.

We claim:

1. A liquid-containing container comprising a removable lid; a liquid within the container; a liquid-tight membrane forming a liquid-tight seal in said container between said liquid and said lid; and a tool holding member within said container, said tool holding member having a recess and being attached to said membrane such that said recess is protected from contact by said liquid.

2. A container as in claim 1, wherein the tool holding member consists of a vacuum-shaped tool tray.

3. A container as in claim 2, wherein the tool tray is fastened to a side of the membrane facing said liquid.

4. A container as in claim 2, wherein said liquid is paint and wherein the tool tray comprises a hole covered by a membrane for introducing tone into a part of the container which is covered by the membrane.

5. A container as in claim 2, wherein the liquid is paint and wherein a part of the membrane consists of a sheet-shaped element which provides an incision for fastening a paint brush.

* * * * *